US006124773A

United States Patent [19]

Okawa et al.

[11] Patent Number: 6,124,773

[45] **Date of Patent: *Sep. 26, 2000**

[54] DEFLECTION YOKE

[75] Inventors: Yusuke Okawa, Iwai; Hiroshi Kimura, Tsuchiura; Takasuke Koga; Naoki Hatakeyama, both of Ibaraki-ken, all of Japan

[73] Assignee: Victor Company of Japan, Ltd., Yokohama, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/009,885

[22] Filed: Jan. 21, 1998

[30] Foreign Application Priority Data

May 15, 1997 [JP] Japan ..... 9-140873

[51] Int. Cl.[7] ..... H01F 7/00

[52] U.S. Cl. ..... 335/213; 439/888

[58] Field of Search ..... 361/772–774; 335/213, 214, 210, 212; 439/888

[56] References Cited

U.S. PATENT DOCUMENTS

| | | | |
|---|---|---|---|
| Re. 35,183 | 3/1996 | Ose et al. | 315/370 |
| 2,935,654 | 5/1960 | Gittens et al. | 361/772 |
| 3,503,033 | 3/1970 | Kennedy, Jr. | 361/772 |
| 3,644,792 | 2/1972 | Fields | 29/626 |
| 3,935,372 | 1/1976 | Tripplett | 174/68.5 |
| 4,405,910 | 9/1983 | Ohtsu | 335/210 |
| 5,386,344 | 1/1995 | Beaman | 361/773 |
| 5,497,936 | 3/1996 | Vojta et al. | 228/173.5 |

FOREIGN PATENT DOCUMENTS 63-44362 3/1988 Japan .

*Primary Examiner*—Lincoln Donovan
*Attorney, Agent, or Firm*—Pollock, Vande Sande & Amernick

[57] ABSTRACT

A deflection yoke includes a coil, a base board, and a terminal. The terminal is mounted on the base board. The terminal extends from the base board. The terminal has a first portion and a second portion. The first portion of the terminal extends from the base board and has a substantially circular cross-section. The second portion of the terminal extends from the first portion thereof and has a cross-section with a corner. A lead extending from the coil is wound on the first and second portions of the terminal as a winding on the terminal. The winding has a first portion and a second portion. The first portion of the winding extends around the first portion of the terminal. The second portion of the winding extends around the second portion of the terminal. At least part of of the second portion of the winding is soldered to the second portion of the terminal while at least part of the first portion of the winding is non-soldered.

3 Claims, 17 Drawing Sheets

DEFLECTION YOKE

BACKGROUND OF THE INVENTION

1. Field of the Invention

This invention relates to a deflection yoke for a cathode-ray tube or other devices using electron beams.

2. Description of the Related Art

In general, cathode-ray tubes are provided with deflection yokes. A typical deflection yoke has terminals to which the leads from deflection coils are soldered.

During the transportation of deflection yokes from a factory, they tend to be exposed to vibrations. In some cases, vibrations break a lead at a position near a solder surface.

SUMMARY OF THE INVENTION

It is an object of this invention to provide a deflection yoke which is improved in mechanical strength.

A first aspect of this invention provides a deflection yoke comprising a coil; a base board; a terminal mounted on the base board and extending from the base board, the terminal having a first portion and a second portion, wherein the first portion of the terminal extends from the base board and has a substantially circular cross-section, and the second portion of the terminal extends from the first portion thereof and has a cross-section with a corner; and a lead extending from the coil and being wound on the first and second portions of the terminal as a winding on the terminal, the winding having a first portion and a second portion, wherein the first portion of the winding extends around the first portion of the terminal, and the second portion of the winding extends around the second portion of the terminal, and wherein at least part of the second portion of the winding is soldered to the second portion of the terminal while at least part of the first portion of the winding is non-soldered.

A second aspect of this invention provides a deflection yoke comprising a coil; a base board; a terminal mounted on the base board and extending from the base board, the terminal having a first portion and a second portion, wherein the first portion of the terminal extends from the base board and has a substantially circular cross-section, and the second portion of the terminal extends from the first portion thereof and has a substantially rectangular cross-section; and a lead extending from the coil and being wound on the first and second portions of the terminal as a winding on the terminal, the winding having a first portion and a second portion, wherein the first portion of the winding extends around the first portion of the terminal, and the second portion of the winding extends around the second portion of the terminal, and wherein at least part of of the second portion of the winding is soldered to the second portion of the terminal while at least part of the first portion of the winding is non-soldered.

A third aspect of this invention provides a deflection yoke comprising a coil; a terminal; and a lead extending from the coil and having a first portion and a second portion adjoining each other, wherein the first portion of the lead is soldered to the terminal while the second portion of the lead forms a helical spring.

A fourth aspect of this invention provides a deflection yoke comprising a coil; a terminal; and a lead extending from the coil and being wound on the terminal as a winding on the terminal, the winding having a first portion and a second portion adjoining each other, wherein the first portion of the winding is soldered to the terminal while the second portion of the winding is non-soldered and forms a helical spring.

DESCRIPTION OF THE PREFERRED EMBODIMENTS

A prior-art deflection yoke will be explained hereinafter for a better understanding of this invention.

Figure 1:
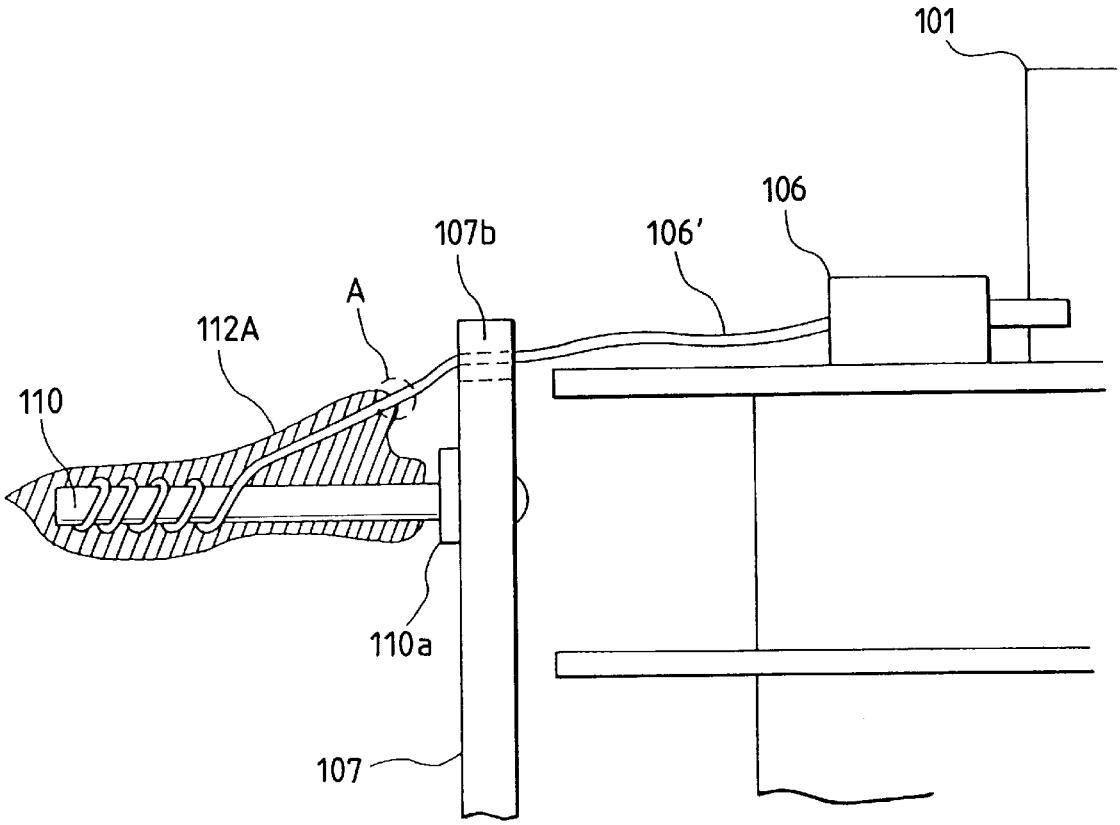
FIG. 1 PRIOR ART
FIG. 1 is a diagram, partly in section, of a portion of a prior-art deflection yoke.

As shown in FIG. 1, the prior-art deflection yoke includes a separator 101, a 4P coil 106, and a base board 107. An electrical circuit (not shown) is mounted on the base board 107. A cylindrical terminal 110 is fixed to the base board 107. The terminal 110 has a flange 110*a* which abuts against a surface of the base board 107.

In the prior-art deflection yoke of FIG. 1, an edge of the base board 107 has a groove 107*b* through which a lead (a wire) 106' extends from the 4P coil 106 to the terminal 110. The lead 106' is wound on the terminal 110 by plural turns. The lead 106' is soldered to the terminal 110. A lump 112A of solder covers the portions of the lead 106' and the terminal 110 which are connected to each other.

Figure 2:
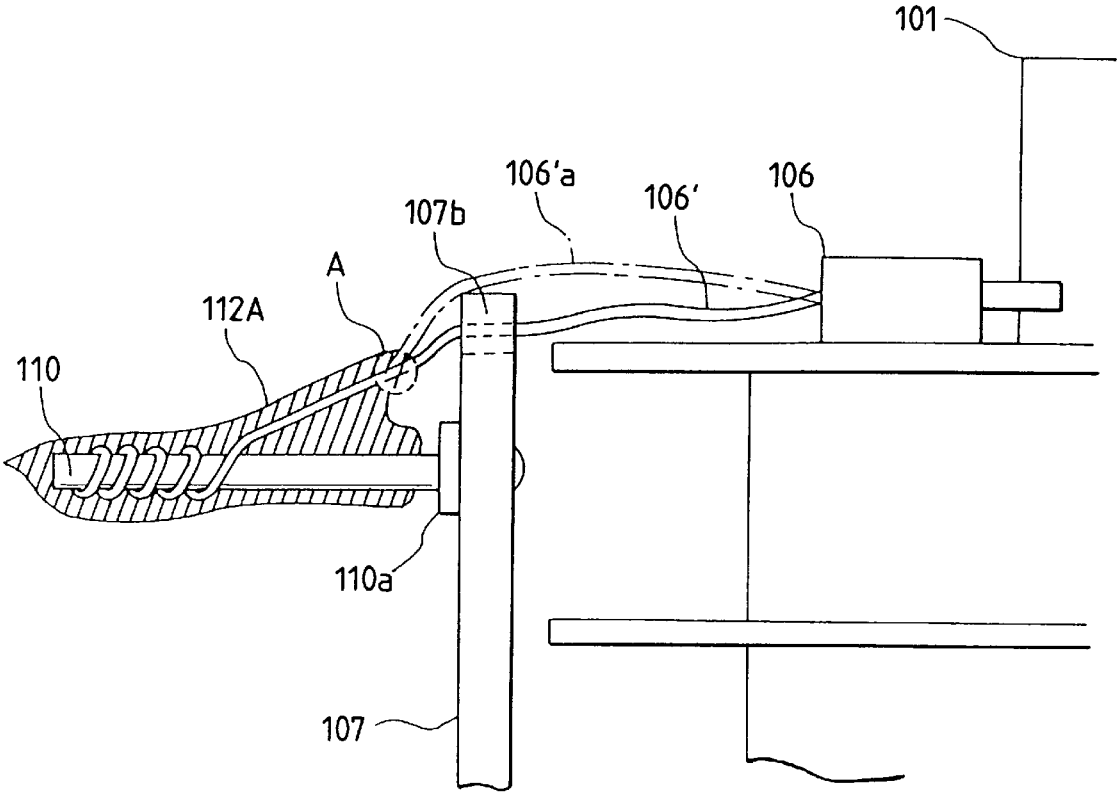
FIG. 2 PRIOR ART
FIG. 2 is a diagram, partly in section, of the portion of the prior-art deflection yoke.

With reference to FIG. 2, while the prior-art deflection yoke remains exposed to vibrations, the portion of the lead 106' between the 4P coil 106 and the solder lump 112A periodically reciprocates between its original position and another position 106'*a* which separates far from the original position. On the other hand, the portion of the lead 106' in the solder lump 112A remains fixed. The lead 106' extends outward of the groove 107*b* in the base board 107 when assuming the position 106'*a*. Thus, during the exposure of the prior-art deflection yoke to the vibrations, the portion "A" of the lead 106' near the surface of the solder lump 112A is periodically deformed or bent by a significant degree. Accordingly, the portion "A" of the lead 106' tends to break.

A deflection yoke of this invention is designed to prevent a lead (a wire) from breaking due to the exposure of vibrations.

First Embodiment

Figure 3:
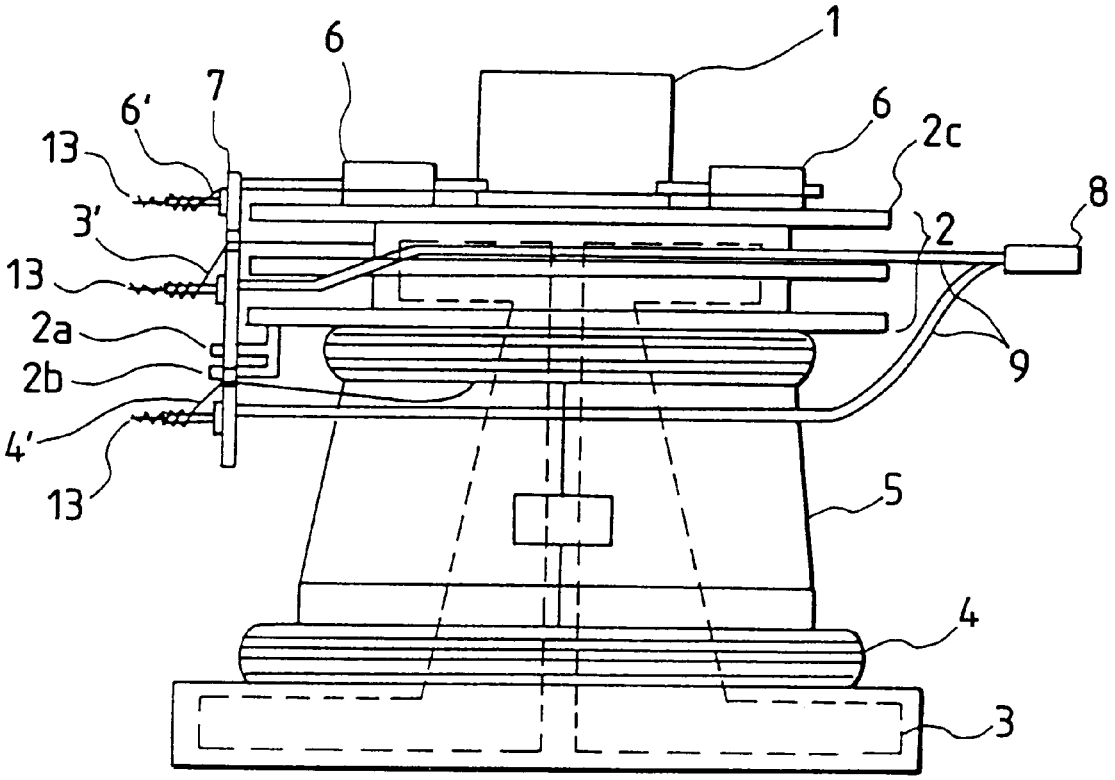
FIG. 3 is a side diagram of a deflection yoke according to a first embodiment of this invention.
Figure 4:
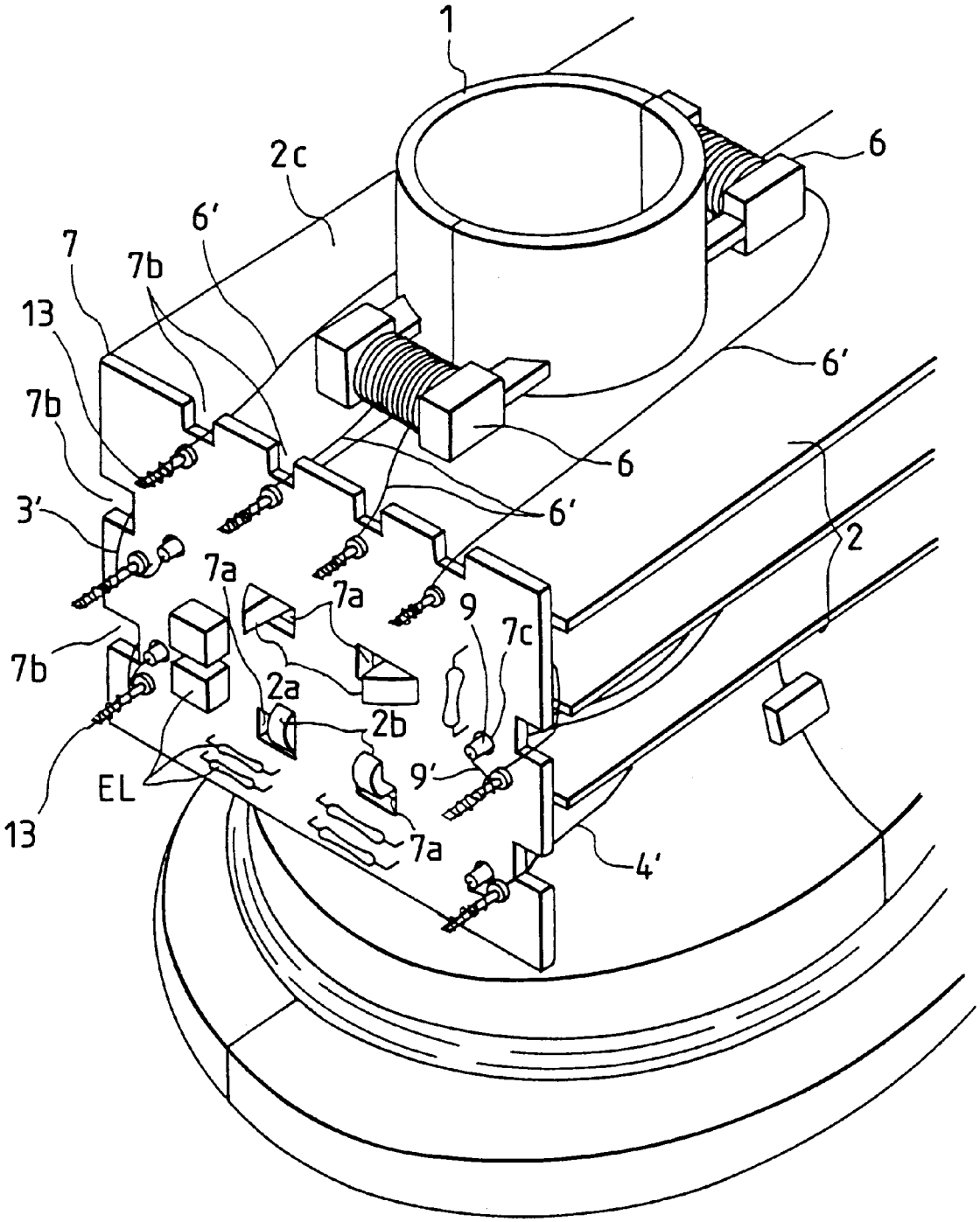
FIG. 4 is a perspective view of a portion of the deflection yoke in FIG. 3.

FIGS. 3 and 4 show a deflection yoke according to a first embodiment of this invention. With reference to FIGS. 3 and 4, the deflection yoke has a substantially cylindrical or horn-like shape with a central axis. The deflection yoke has opposite ends as viewed along the axial direction thereof. In FIG. 3, the upper end and the lower end of the deflection yoke are referred as the neck side and the face side, respectively.

The deflection yoke of FIGS. 3 and 4 includes a separator 1 having a horn-like shape. The separator 1 has a neck side provided with plural flanges 2. An edge of at least one of the separator flanges 2 has elastic claws 2*a* and 2*b*. The claws 2*a* and 2*b* are integral with the remainder of the related flange 2.

The deflection yoke of FIGS. 3 and 4 also includes a horizontal deflection coil 3, a vertical deflection coil 4, a core 5, 4P coils 6, and a base board 7. The horizontal deflection coil 3 has a saddle-like shape. Also, the vertical deflection coil 4 has a saddle-like shape. The horizontal deflection coil 3 and the vertical deflection coil 4 are electrically insulated from each other by the separator 1. The horizontal deflection coil 3 and the vertical deflection coil 4 are supported by the separator 1. Leads or wires 3' extend from the horizontal deflection coil 3. Leads or wires 4' extend from the vertical deflection coil 4. The core 5 is made of, for example, ferrite. The horizontal deflection coil 3 extends inward of the core 5. The vertical deflection coil 4 extends around the core 5. The 4P coils 6 are supported on the separator 1 via suitable members (no reference numeral). Leads or wires 6' extend from the 4P coils 6. The base board 7 is supported by the flanges 2 of the separator 1. An electrical circuit is mounted on the base board 7. The electrical circuit includes electrical parts EL attached to the base board 7.

A connector 8 is used for electrical connection between the deflection yoke and a power supply. When the deflection yoke is electrically connected to the power supply via the connector 8, the deflection yoke receives an electrical current from the power supply. Connector cables 9 electrically connect the connector 8 and terminals on the base board 7.

The base board 7 has rectangular apertures 7*a* for receiving the respective claws 2*a* and 2*b* of the separator flange 2. During the assembly of the deflection yoke, the claws 2*a* and 2*b* of the separator flange 2 are inserted into the corresponding apertures 7*a* in the base board 7, being moved into engagement with the base board 7. In this way, the base board 7 is attached to the separator flange 2. Edges of the base board 7 have grooves 7*b* for receiving the respective leads 3', 4', and 6'. The base board 7 has circular apertures 7*c* for receiving the respective connector cables 9.

Terminals 13 are mounted on the base board 7. The leads 3', 4', and 6', and also leads 9' extending from ends of the connector cables 9 are helically wound on the respective terminals 13 by plural turns. The leads 3', 4', 6', and 9' are soldered to the terminals 13, respectively.

Figure 5:
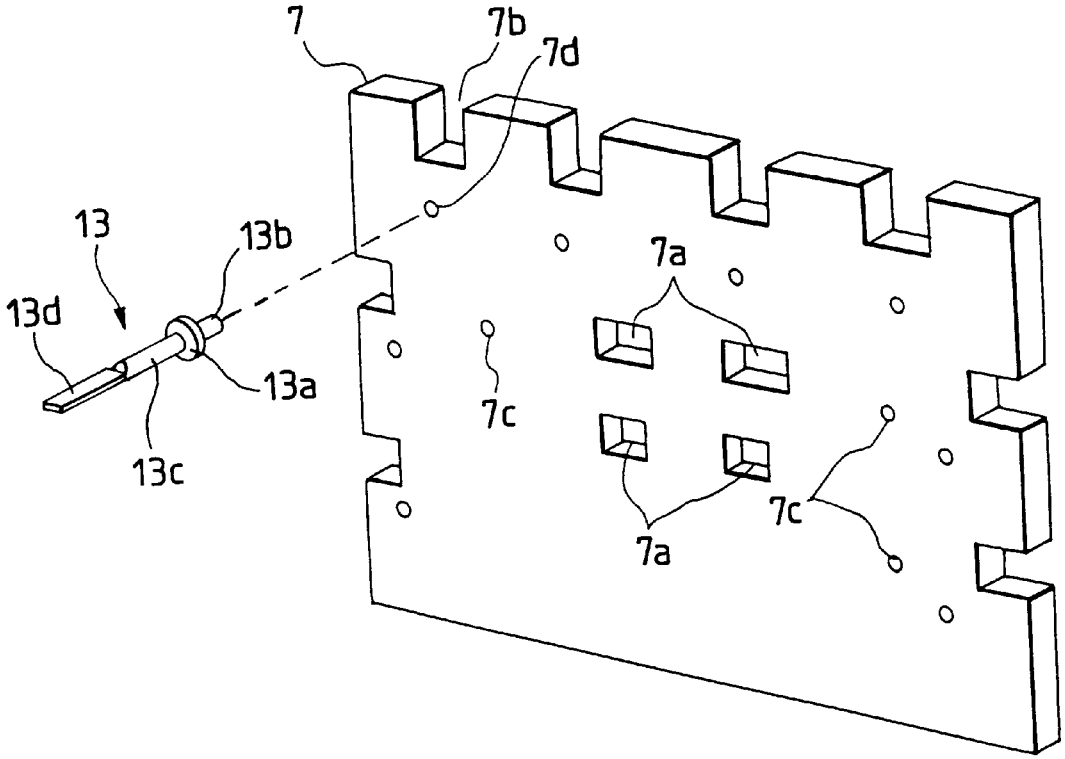
FIG. 5 is a perspective exploded view of a base board and a terminal in the deflection yoke in FIG. 3.

As shown in FIG. 5, the base board 7 has apertures 7*d* for receiving the terminals 13. The terminals 13 have equal shapes. Only one of the terminals 13 will be explained in detail hereinafter.

Figure 6:
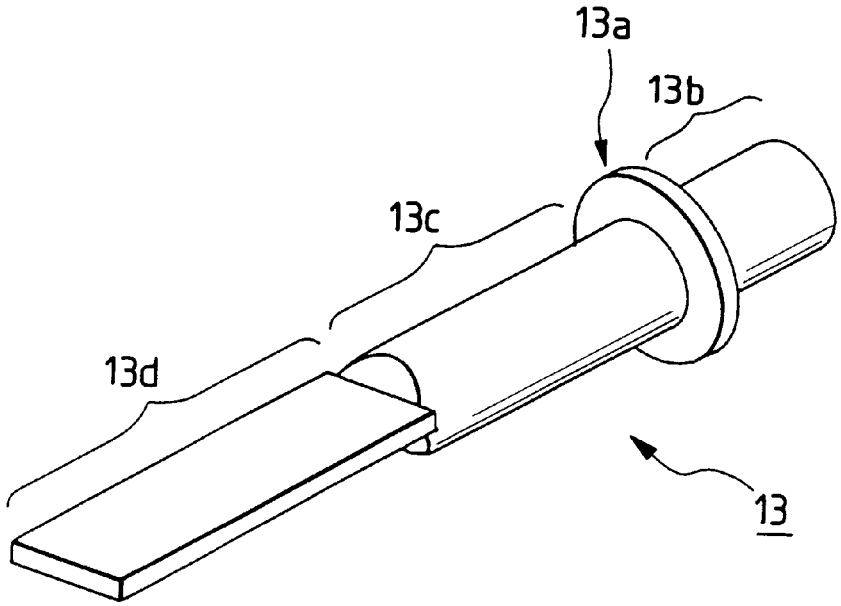
FIG. 6 is a perspective view of a terminal in the deflection yoke of FIG. 3.
Figure 7:
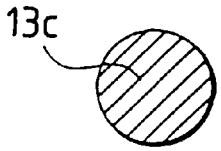
FIG. 7 is a sectional view of a circular portion of the terminal in FIG. 6.
Figure 8:
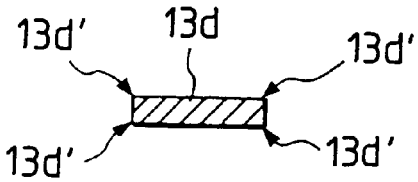
FIG. 8 is a sectional view of a flat plate portion of the terminal in FIG. 6.

As shown in FIG. 6, the terminal 13 has a stick-like shape formed with an annular flange 13*a*. The terminal 13 has a base portion 13*b* extending from the flange 13*a* in the rightward direction as viewed in FIG. 6. The base portion 13*b* has a circular cross-section. The terminal 13 has a cylindrical portion 13*c* extending from the flange 13*a* in the leftward direction as viewed in FIG. 6. As shown in FIG. 7, the cylindrical portion 13*c* has a circular cross-section. The terminal 13 has a flat strip portion 13*d* extending from the left-hand end of the cylindrical portion 13*c* in the leftward direction as viewed in FIG. 6. As shown in FIG. 8, the flat strip portion 13*d* has a flat rectangular cross-section with four corners 13*d'*.

For example, the cylindrical portion 13*c* and the flat strip portion 13*d* originate from a common cylinder. A part of the common cylinder is deformed into the flat strip portion 13*d* by a pressing process. The remainder of the common cylinder forms the cylindrical portion 13*c*.

Figure 9:
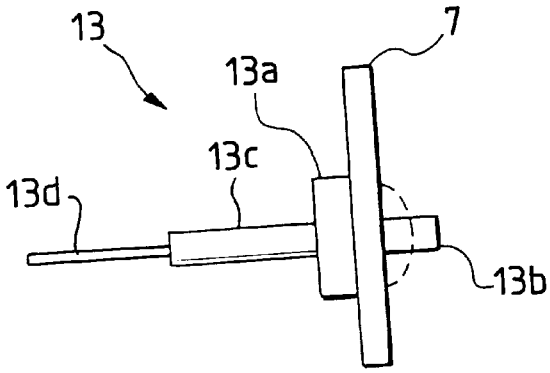
FIG. 9 is a side diagram of a base board and a terminal in the deflection yoke of FIG. 3.

With reference to FIG. 9, during the assembly of a combination of the base board 7 and the terminals 13, the base portion 13*b* of each of the terminals 13 is fitted or inserted into the corresponding aperture 7*d* in the base board 7 until the flange 13*a* thereof contacts the surface of the base board 7. At this time, an end of the base portion 13*b* of each of the terminals 13 projects outward from the corresponding aperture 7*d* in the back side of the base board 7. Then, the end of the base portion 13*b* is deformed by a pressing process into a hemispherical shape having a diameter greater than the diameter of the corresponding aperture 7*d* in the base board 7. In FIG. 9, the deformation-resultant shape of the end of the base portion 13*b* is illustrated by the broken line. Thus, the deformed end of the base portion 13*b* firmly engages the back surface of the base board 7. Specifically, the wall of the base board 7 is firmly held between the flange 13*a* and the deformed end of the base portion 13*b* of the terminal 13. In other words, the terminal 13 is mounted on the base board 7. The flange 13*a* and the deformed end of the base portion 13*b* cooperate to prevent the separation of the terminal 13 from the base board 7.

Figure 10:
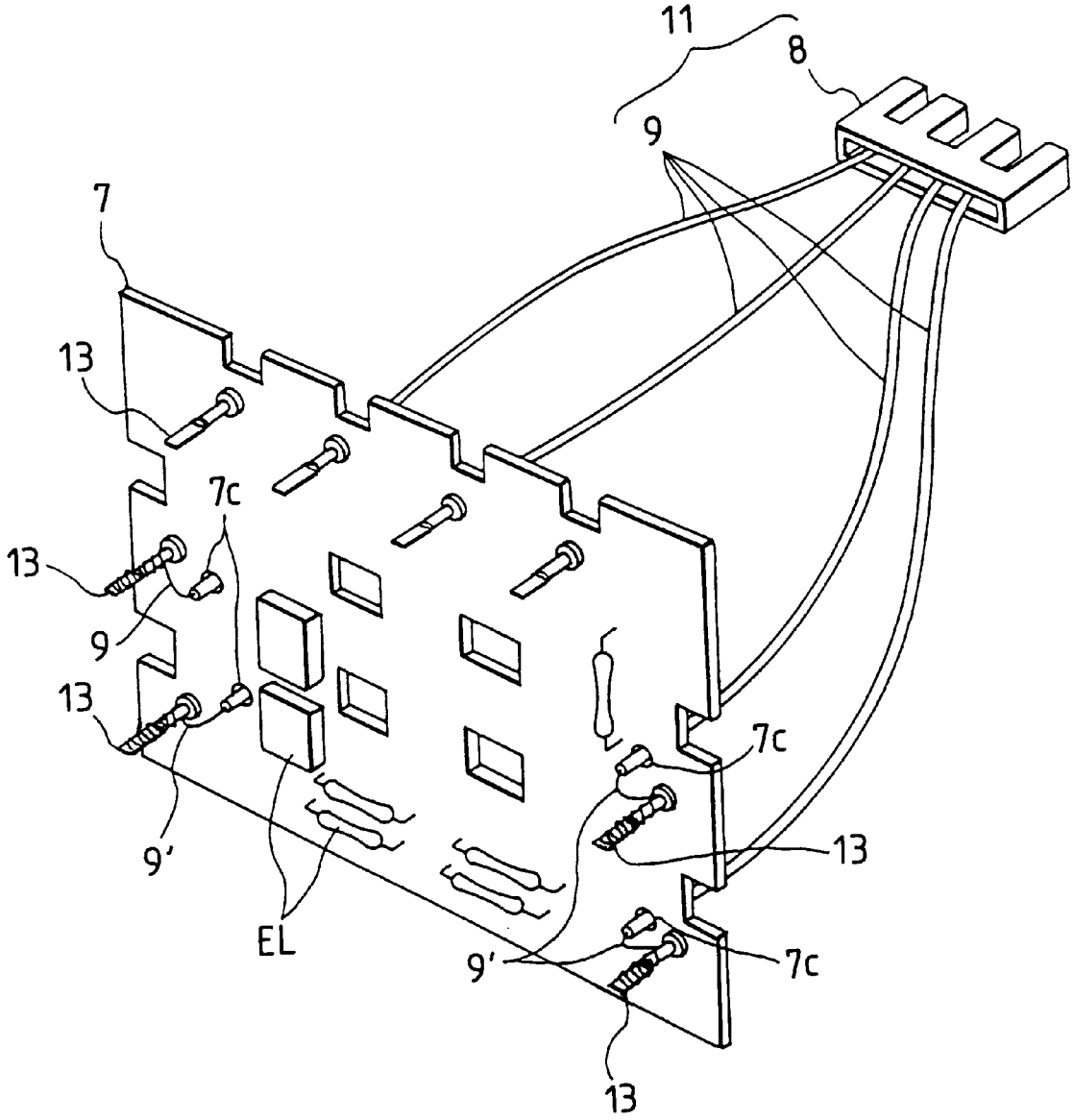
FIG. 10 is a perspective view of an assembly of a base board, a connector, and connector cables which is present at a pre-stage before a main stage of the assembly of the deflection yoke of FIG. 3.

FIG. 10 shows a combination of the base board 7, the connector 8, and the connector cables 9 in states which occur at a pre-stage before a main stage of the assembly of the deflection yoke. During a step of making the structure in FIG. 10, the connector 8 and the connector cables 9 are combined or connected into a connector assembly 11. Then, ends of the connector cables 9 are passed through the respective apertures 7*c* in the base board 7. The leads 9' which extend from the end faces of the cables 9 are helically wound on the cylindrical portions 13*c* and the flat strip portions 13*d* of the respective related terminals 13 by plural turns.

After the structure in FIG. 10 is completed, the base board 7 is attached to the flange 2 of the separator 1. With reference back to FIG. 4, during the assembly of the deflection yoke, the leads 3', 4', and 6' extending from the horizontal deflection coil 3, the vertical deflection coil 4, and the 4P coils 6 are passed through the respective grooves 7*b* in the base board 7. The leads 3', 4', and 6' are helically wound on the cylindrical portions 13*c* and the flat strip portions 13*d* of the respective related terminals 13 by plural turns. Winding the leads 3', 4', and 6' on the terminals 13 is implemented by a manual process or a machine-based automatic process. Surplus ends of the 3', 4', and 6' are removed by a cutting process.

The connections of the leads 3', 4', and 6' to the respective terminals 13 are similar to each other. Only one of the connections of the leads 3', 4', and 6' to the respective terminals 13 will be explained in detail hereinafter.

Figure 11:
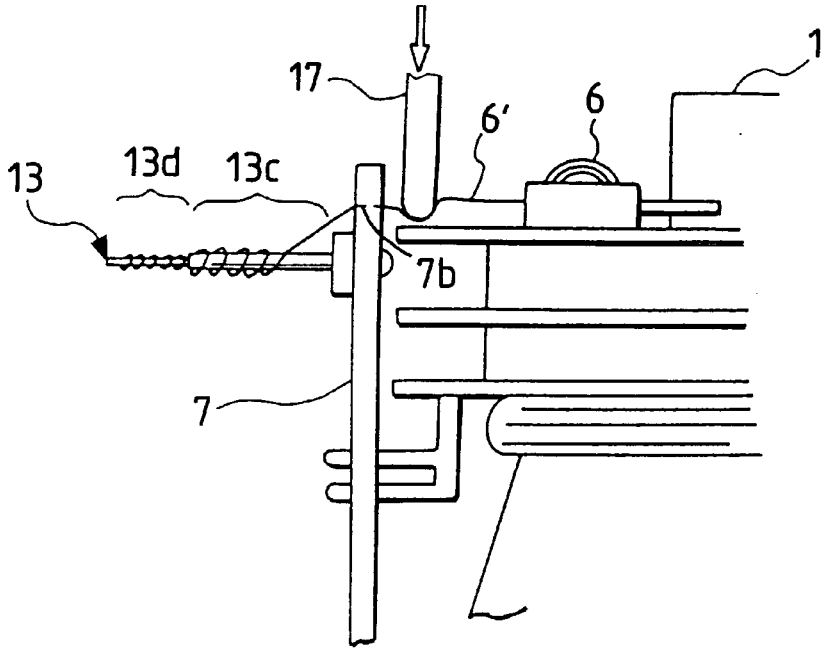
FIG. 11 is a side view of a portion of a terminal, a base board, and a lead in states which occur during the assembly of the deflection yoke in FIG. 3.
Figure 12:
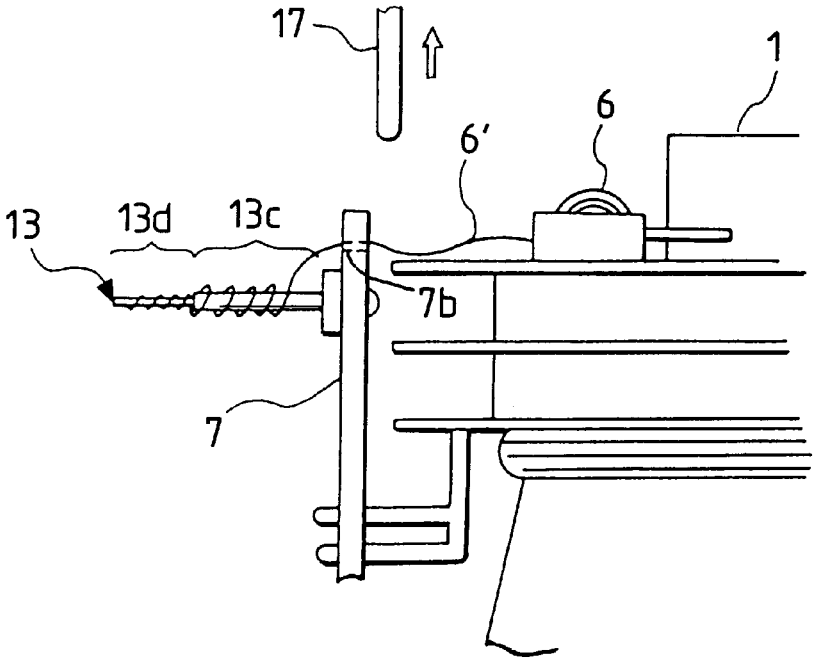
FIG. 12 is a side view of a portion of a terminal, a base board, and a lead in states which occur during the assembly of the deflection yoke in FIG. 3.

As shown in FIG. 11, during the assembly of the deflection yoke, the lead 6' extending from the 4P coil 6 is pressed downward by a jig 17. Thus, the lead 6' is bent by the jig 17. The lead 6' is passed through the related groove 7*b* in the base board 7. The lead 6' is helically wound on the cylindrical portion 13*c* of the related terminal 13 by several turns while being pulled in a direction away from the 4P coil 6 and being bent by the jig 17. Then, the lead 6' is further helically wound on the flat strip portion 13*d* of the related terminal 13 by plural turns while being pulled in the direction away from the 4P coil 6 and being bent by the jig 17. Preferably, the winding of the lead 6' is designed to extend up to the tip of the flat strip portion 13*d*. Subsequently, as shown in FIG. 12, the jig 17 is separated from the lead 6'. A surplus end of the lead 6' which can not be wound on the flat strip portion 13*d* of the related terminal 13 is removed by a cutting process.

As shown in FIG. 12, the winding of the lead 6' on the cylindrical portion 13*c* of the related terminal 13 loosens by a certain degree after the jig 17 is separated from the lead 6'. The loosening of the winding of the lead 6' on the cylindrical portion 13*c* is caused by small friction between the winding and the surface of the cylindrical portion 13*c*. On the other hand, each turn of the winding of the lead 6' on the flat strip portion 13*d* of the related terminal 13 is shaped into a rectangle conforming to the rectangular cross-section of the flat strip portion 13*d* so that the winding of the lead 6' clings to the flat strip portion 13*d*. Thus, friction between the winding and the surface of the flat strip portion 13*d* is relatively great. Therefore, the winding of the lead 6' on the flat strip portion 13*d* of the related terminal 13 hardly loosens after the jig 17 is separated from the lead 6'.

Figure 13:
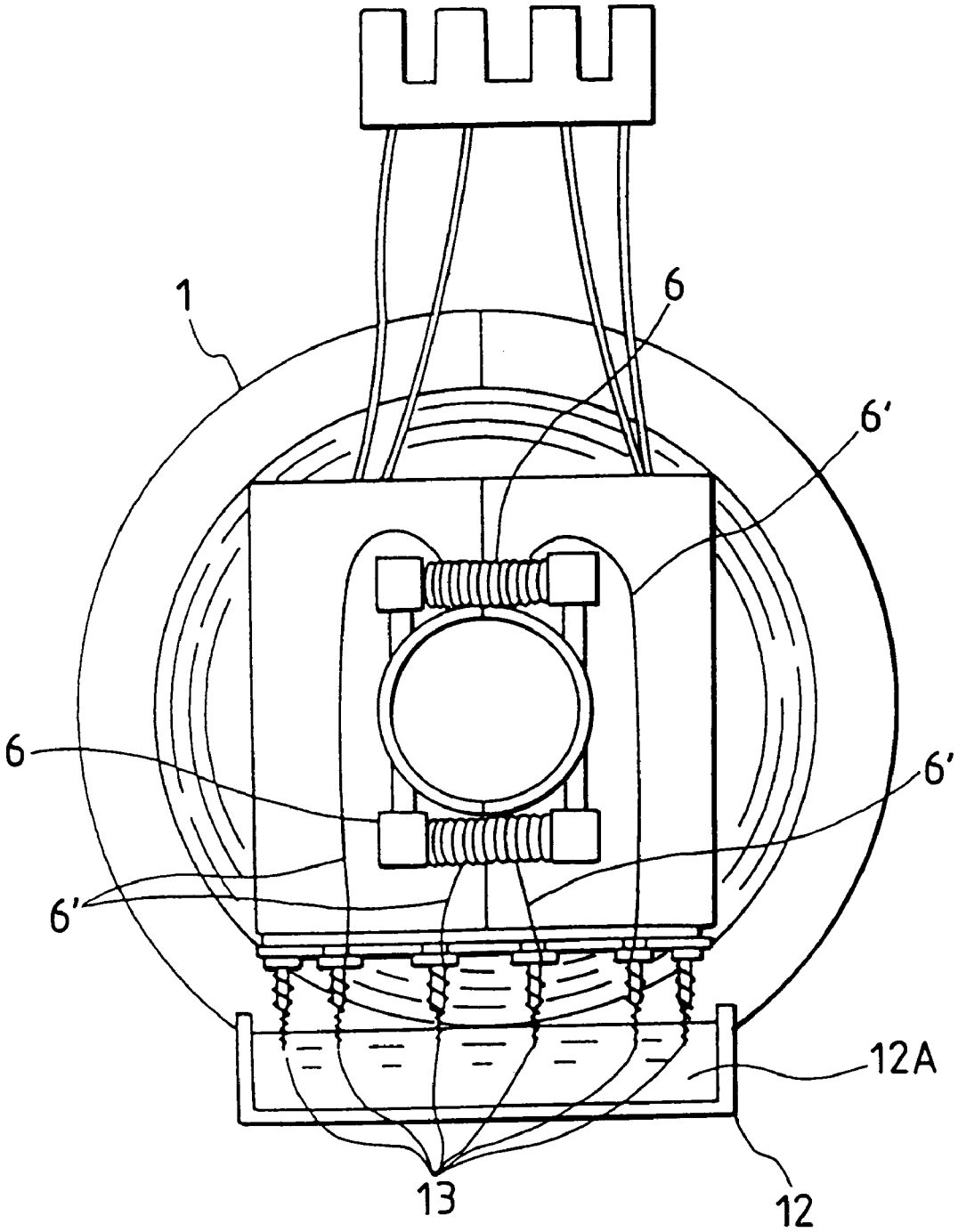
FIG. 13 is a diagram, partly in section, of the deflection yoke and a solder vessel in states which occur during the assembly of the deflection yoke in FIG. 3.
Figure 14:
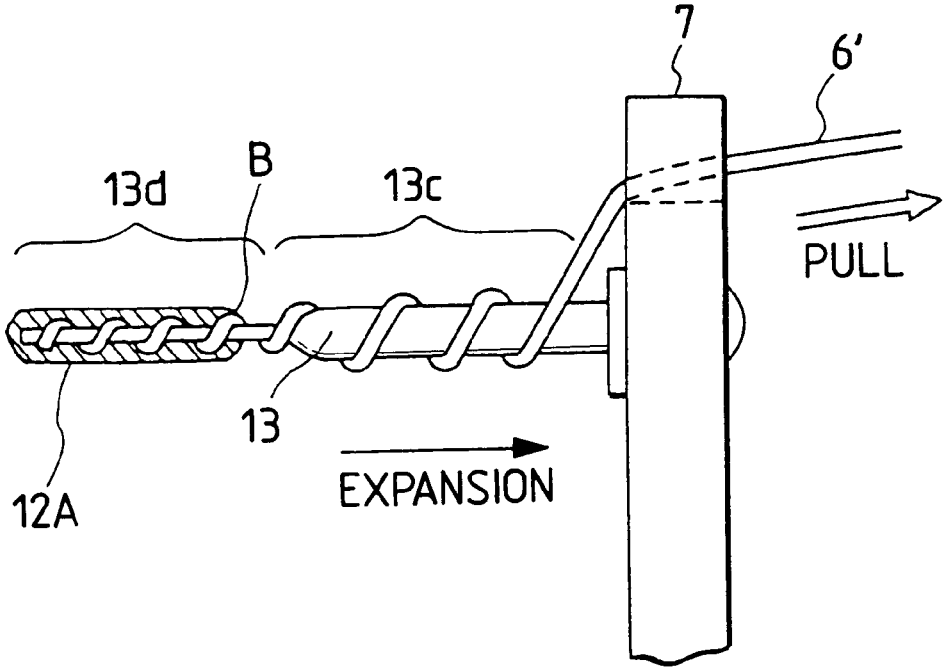
FIG. 14 is a diagram, partly in section, of a terminal, a winding of a lead thereon, and a lump of solder in the deflection yoke in FIG. 3.
Figure 15:
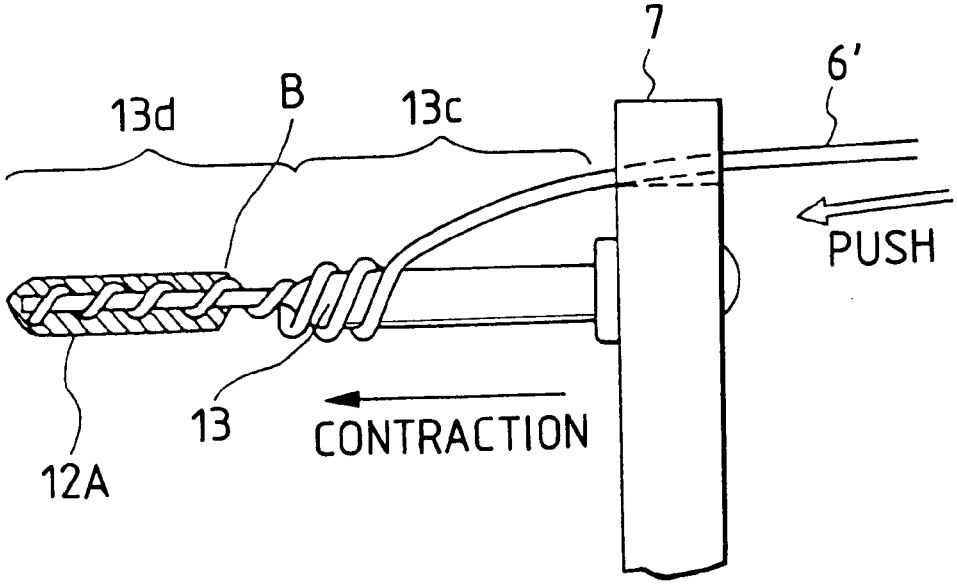
FIG. 15 is a diagram, partly in section, of a terminal, a winding of a lead thereon, and a lump of solder in the deflection yoke in FIG. 3.

With reference to FIG. 13, after the leads 3', 4', and 6' have been wound on the respective terminals 13, portions of the terminals 13 are dipped in solder 12A within a vessel 12. Specifically, the flat strip portions 13*d* of the terminals 13 are dipped in the solder 12A. As shown in FIG. 14, after the terminals 13 are moved out of the solder vessel 12, the flat strip portion 13*d* of each of the terminals 13 and the winding of the lead (3', 4', or 6') thereon are covered by a lump 12A of solder while the cylindrical portion 13*c* of each of the terminals 13 and the winding of the lead (3', 4', or 6') thereon remain uncovered. In this way, the windings of the leads 3', 4', and 6' are bonded to the flat strip portions 13*d* of the terminals 13 by the solder lumps 12A, respectively.

In general, the assembly of the deflection yoke is completed when the previously-mentioned soldering process ends.

In the deflection yoke, the windings of the leads 3', 4', and 6' around the cylindrical portions 13*c* of the terminals 13 serve as contractible and expandible helical springs. During the exposure of the deflection yoke to vibrations, the leads 3', 4', and 6' tend to be periodically pulled away from the terminals 13 and periodically pushed toward the tips of the terminals 13. In this case, the windings of the leads 3', 4', and 6' around the cylindrical portions 13*c* of the terminals 13 operate similarly. Only the operation of one of the windings of the leads 3', 4', and 6' around the cylindrical portions 13*c* of the terminals 13 will be explained in detail hereinafter.

As shown in FIG. 14, when the lead 6' is pulled away from the related terminal 13, the winding of the lead 6' around the cylindrical portion 13*c* of the terminal 13 expands similarly to expansion of a helical spring. When the lead 6' is pushed toward the tip of the related terminal 13, the winding of the lead 6' around the cylindrical portion 13*c* of the terminal 13 contracts similarly to contraction of a helical spring. The expansion and the contraction of the winding of the lead 6' around the cylindrical portion 13*c* prevent a part of the lead 6' near the surface of the solder lump 12A from being periodically deformed or bent by a significant degree. Accordingly, it is possible to effectively prevent the part of the lead 6' near the surface of the solder lump 12A from breaking during the exposure of the deflection yoke to the vibrations.

Only a part of the flat strip portion 13*d* of each of the terminals 13 and the winding of the lead (3', 4', or 6') thereon may be covered by the solder lump 12A. A part of the cylindrical portion 13*c* of each of the terminals 13 and the winding of the lead (3', 4', or 6') therearound may be covered by the solder lump 12A in addition to the flat strip portion 13*d* of each of the terminals 13 and the winding of the lead (3', 4', or 6') thereon.

Second Embodiment

A second embodiment of this invention is similar to the first embodiment thereof except for the following design change. The second embodiment of this invention includes terminals 213 instead of the terminals 13. The terminals 213 are similar to each other. Only one of the terminals 213 will be explained in detail hereinafter.

Figure 16:
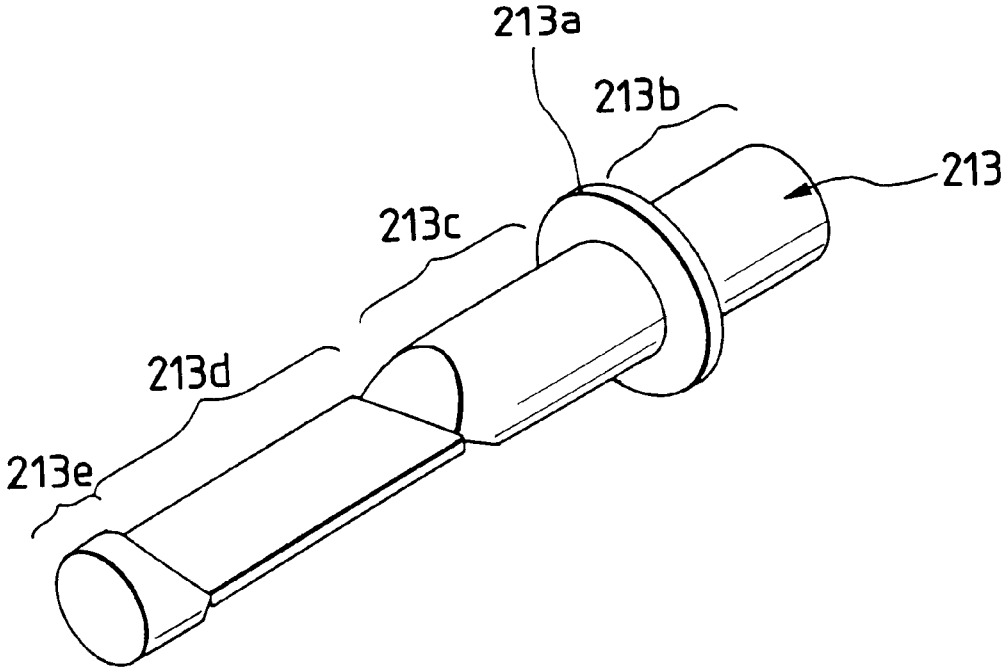
FIG. 16 is a perspective view of a terminal in a deflection yoke according to a second embodiment of this invention.

As shown in FIG. 16, the terminal 213 has a stick-like shape formed with an annular flange 213*a*. The terminal 213 has a base portion 213*b* extending from the flange 213*a* in the rightward direction as viewed in FIG. 16. The base portion 213*b* is fitted into the related aperture 7*d* in the base board 7 (see FIG. 5). The base portion 213*b* has a circular cross-section. The terminal 213 has a cylindrical portion 213*c* extending from the flange 213*a* in the leftward direction as viewed in FIG. 16. The cylindrical portion 213*c* has a circular cross-section. The terminal 213 has a flat strip portion 213*d* extending from the left-hand end of the cylindrical portion 213*c* in the leftward direction as viewed in FIG. 16. The flat strip portion 213*d* has a flat rectangular cross-section with four corners. The terminal 213 has a cylindrical portion 213*e* extending from the left-hand end of the flat strip portion 213*d* in the leftward direction as viewed in FIG. 16. The cylindrical portion 213*e* has a circular cross-section.

The lead 3', 4', or 6' (see FIG. 4) is wound on the cylindrical portion 213*c* and the flat strip portion 213*d* of the related terminal 213. The lead 3', 4', or 6' (see FIG. 4) may be wound on the cylindrical portion 213*c*, the flat strip portion 213*d*, and the cylindrical portion 213*e* of the terminal 213.

Third Embodiment

A third embodiment of this invention is similar to the first embodiment thereof except for the following design change. The third embodiment of this invention includes terminals 14 instead of the terminals 13. The terminals 14 are similar to each other. Only one of the terminals 14 will be explained in detail hereinafter.

Figure 17:
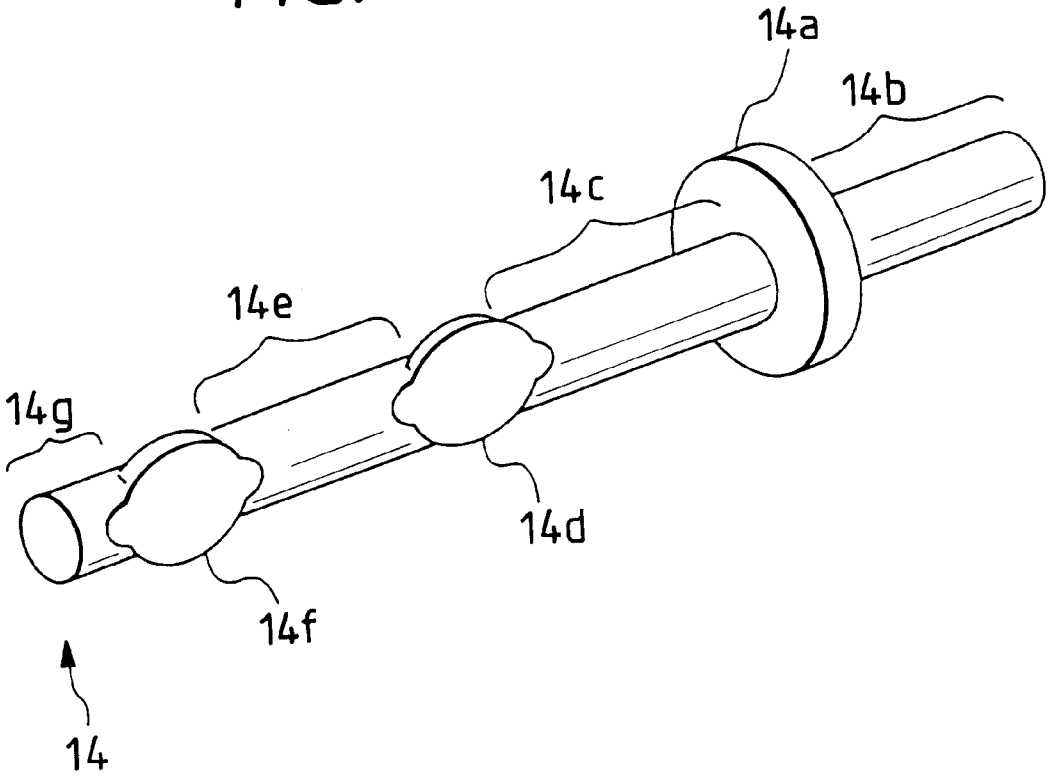
FIG. 17 is a perspective view of a terminal in a deflection yoke according to a third embodiment of this invention.
Figure 18:
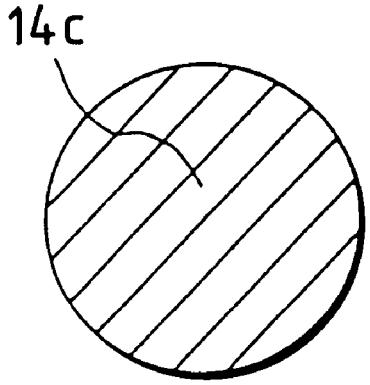
FIG. 18 is a sectional view of a cylindrical portion of the terminal in FIG. 17.
Figure 19:
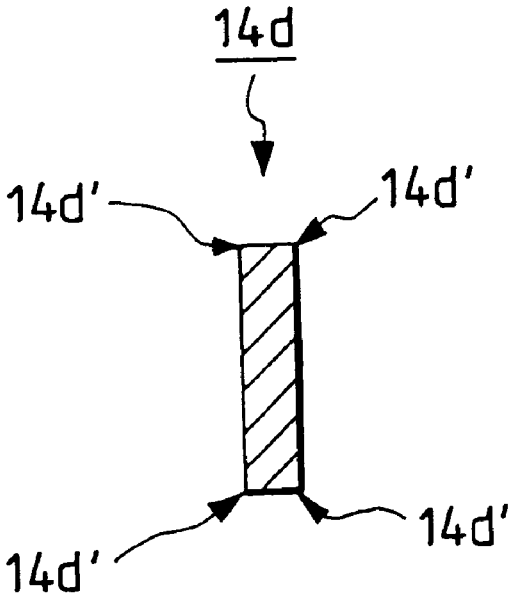
FIG. 19 is a sectional view of a flat portion of the terminal in FIG. 17.

As shown in FIG. 17, the terminal 14 has a stick-like shape formed with an annular flange 14*a*. The terminal 14 has a base portion 14*b* extending from the flange 14*a* in the rightward direction as viewed in FIG. 17. The base portion 14*b* is fitted into the related aperture 7*d* in the base board 7 (see FIG. 5). The base portion 14*b* has a circular cross-section. The terminal 14 has a cylindrical portion 14*c* extending from the flange 14*a* in the leftward direction as viewed in FIG. 17. As shown in FIG. 18, the cylindrical portion 14*c* has a circular cross-section. The terminal 14 has a flat portion 14*d* extending from the left-hand end of the cylindrical portion 14*c* in the leftward direction as viewed in FIG. 17. As shown in FIG. 19, the flat portion 14*d* has a flat rectangular cross-section with four corners 14*d'*. The terminal 14 has a cylindrical portion 14*e* extending from the left-hand end of the flat portion 14*d* in the leftward direction as viewed in FIG. 17. The cylindrical portion 14*e* has the circular cross-section same as that of the cylindrical portion 14*c*. The terminal 14 has a flat portion 14*f* extending from the left-hand end of the cylindrical portion 14*e* in the leftward direction as viewed in FIG. 17. The flat portion 14*f* has the flat rectangular cross-section same as that of the flat portion 14*d*. The terminal 14 has a cylindrical portion 14*g* extending from the left-hand end of the flat portion 14*f* in the leftward direction as viewed in FIG. 17. The cylindrical portion 14*g* has the circular cross-section same as that of the cylindrical portion 14*c*.

For example, the cylindrical portions 14*c*, 14*e*, and 14*g*, and the flat portions 14*d* and 14*f* originate from a common cylinder. Parts of the common cylinder are deformed into the flat portions 14*d* and 14*f* by a pressing process. The remainder of the common cylinder forms the cylindrical portions 14*c*, 14*d*, and 14*e*.

Figure 20:
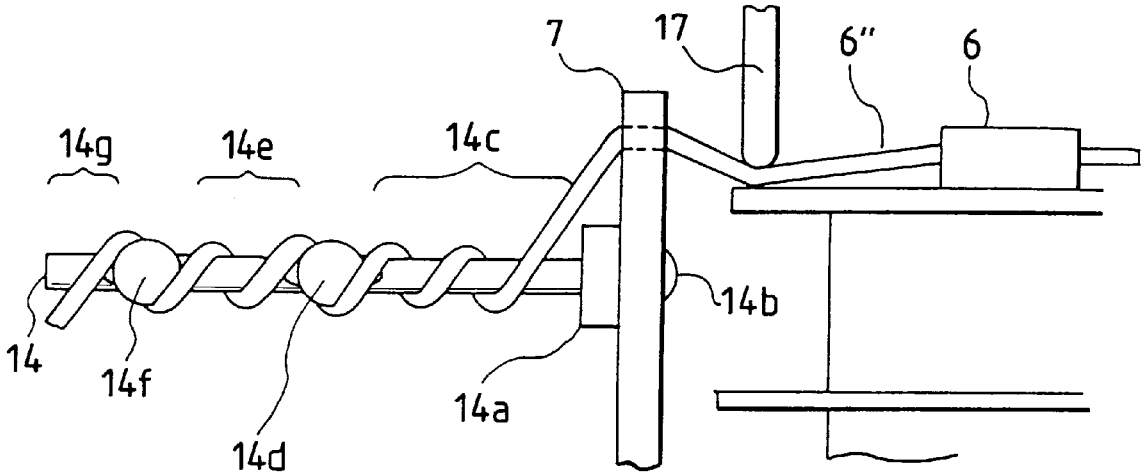
FIG. 20 is a side diagram of a terminal, a winding of a lead thereon, and a base board in states which occur during the assembly of a deflection yoke of the third embodiment of this invention.
Figure 21:
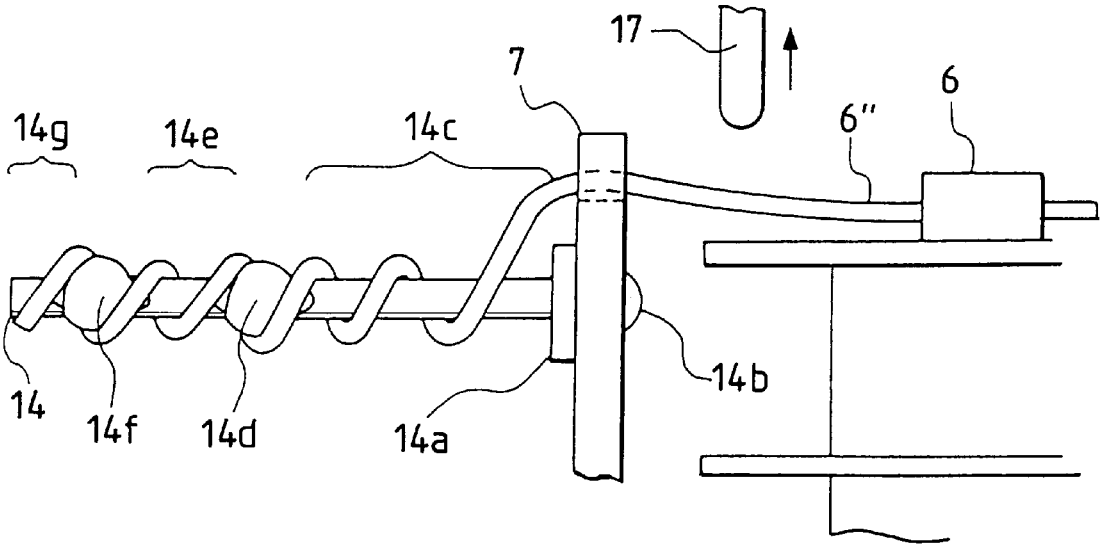
FIG. 21 is a side diagram of a terminal, a winding of a lead thereon, and a base board in states which occur during the assembly of a deflection yoke of the third embodiment of this invention.

As shown in FIG. 20, during the assembly of the deflection yoke, a relatively-thick lead 6" extending from the 4P coil 6 is pressed downward by the jig 17. Thus, the lead 6" is bent by the jig 17. The lead 6" is passed through the related groove 7*b* in the base board 7. The lead 6" is helically wound on the cylindrical portions 14*c*, 14*e*, and 14*g*, and the flat portions 14*e* and 14*f* of the related terminal 14 by several turns while being pulled in a direction away from the 4P coil 6 and being bent by the jig 17. Subsequently, as shown in FIG. 21, the jig 17 is separated from the lead 6". A surplus end of the lead 6" which can not be wound on the related terminal 14 is removed by a cutting process.

As shown in FIG. 21, the winding of the lead 6" on the cylindrical portion 14*c* of the related terminal 14 loosens by a certain degree after the jig 17 is separated from the lead 6". The loosening of the winding of the lead 6" on the cylindrical portion 14*c* is caused by small friction between the winding and the surface of the cylindrical portion 14*c*. On the other hand, each turn of the winding of the lead 6" on the flat portions 14*d* and 14*f* of the related terminal 14 is shaped into a rectangle conforming to the rectangular cross-section of the flat portions 14*d* and 14*f* so that the winding of the lead 6" clings to the flat portions 14*d* and 14*f*. Thus, friction between the winding and the surfaces of the flat portions 14*d* and 14*f* are relatively great. Therefore, the winding of the lead 6" on the flat portions 14*d* and 14*f* of the related terminal 14 hardly loosens after the jig 17 is separated from the lead 6". Also, the winding of the lead 6" on the cylindrical portion 14*e* of the related terminal 14 between the flat portions 14*d* and 14*f* thereof hardly loosens after the jig 17 is separated from the lead 6".

Figure 22:
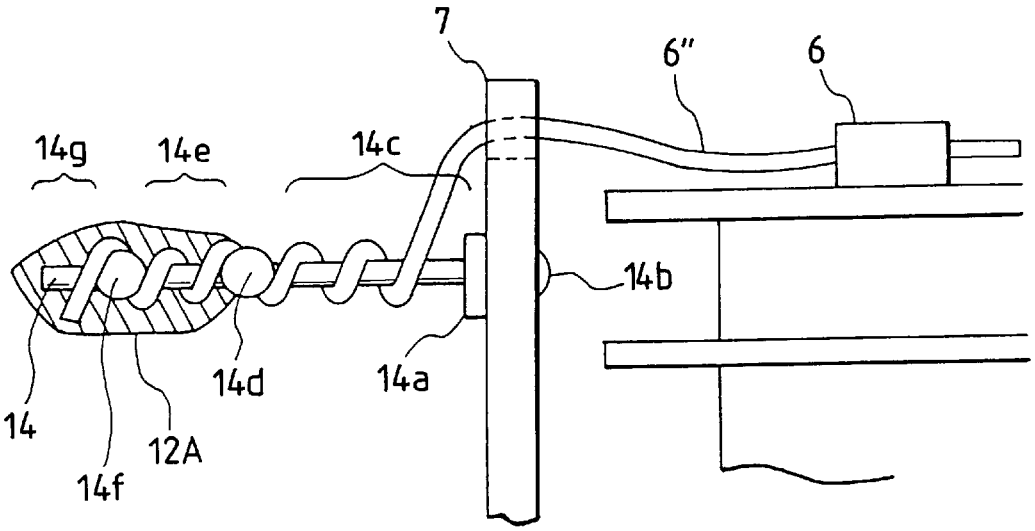
FIG. 22 is a diagram, partly in section, of a terminal, a winding of a lead thereon, a lump of solder, and a base board in the deflection yoke of the third embodiment of this invention.

As shown in FIG. 22, during the assembly of the deflection yoke, the cylindrical portions 14*e* and 14*g* of the terminal 14, the flat portion 14*f* of the terminal 14, and the winding of the lead 6" thereon are covered by a lump 12A of solder while the cylindrical portion 14*c* of the terminal 14, the flat portion 14*d* of the terminal 14, and the winding of the lead 6" thereon remain uncovered. In this way, the winding of the lead 6" is bonded to the cylindrical portions 14*e* and 14*g* and the flat portion 14*f* of the terminal 14 by the solder lump 12A.

In the deflection yoke, the winding of the lead 6" around the cylindrical portion 14*c* of the terminal 14 serves as a contractible and expandible helical spring.

The cylindrical portions 14*e* and 14*g* of the terminal 14, the flat portions 14*d* and 14*f* of the terminal 14, and the winding of the lead 6" thereon may be covered by a lump 12A of solder while the cylindrical portion 14*c* of the terminal 14, the flat portion 14*d* of the terminal 14, and the winding of the lead 6" thereon remain uncovered. Alternatively, at least part of the cylindrical portions 14*e* and 14*g* of the terminal 14, the flat portions 14*d* and 14*f* of the terminal 14, and the winding of the lead 6" thereon may be covered by a lump 12A of solder. For example, only the cylindrical portion 14*g* of the terminal 14, the flat portion 14*f* of the terminal 14, and the winding of the lead 6" thereon may be covered by a lump 12A of solder.

Fourth Embodiment

A fourth embodiment of this invention is similar to the first embodiment thereof except for the following design change. The fourth embodiment of this invention uses leads 6" instead of the leads 6' extending from the 4P coils 6. The leads 6" are thicker than the leads 6'.

Figure 23:
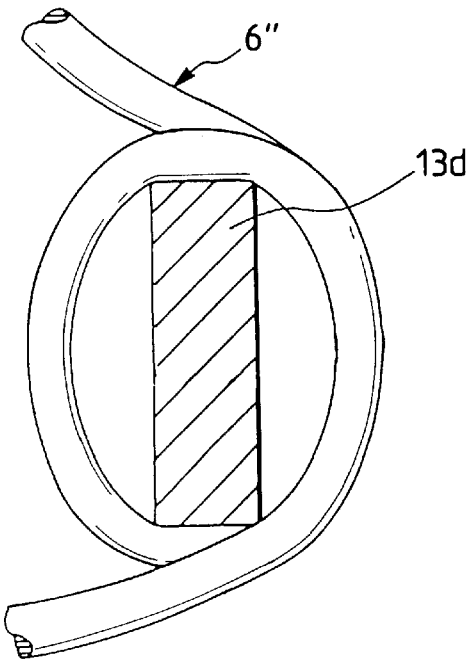
FIG. 23 is a sectional diagram of a terminal and a lead in a deflection yoke according to a fourth embodiment of this invention.

As shown in FIG. 23, during the assembly of the deflection yoke, the lead 6" is wound on the flat strip portion 13*d* of the related terminal 13.

Fifth Embodiment

A fifth embodiment of this invention is similar to the third embodiment thereof except for the following design change. The fifth embodiment of this invention includes terminals 16 instead of the terminals 14. The terminals 16 are similar to each other. Only one of the terminals 16 will be explained in detail hereinafter.

Figure 24:
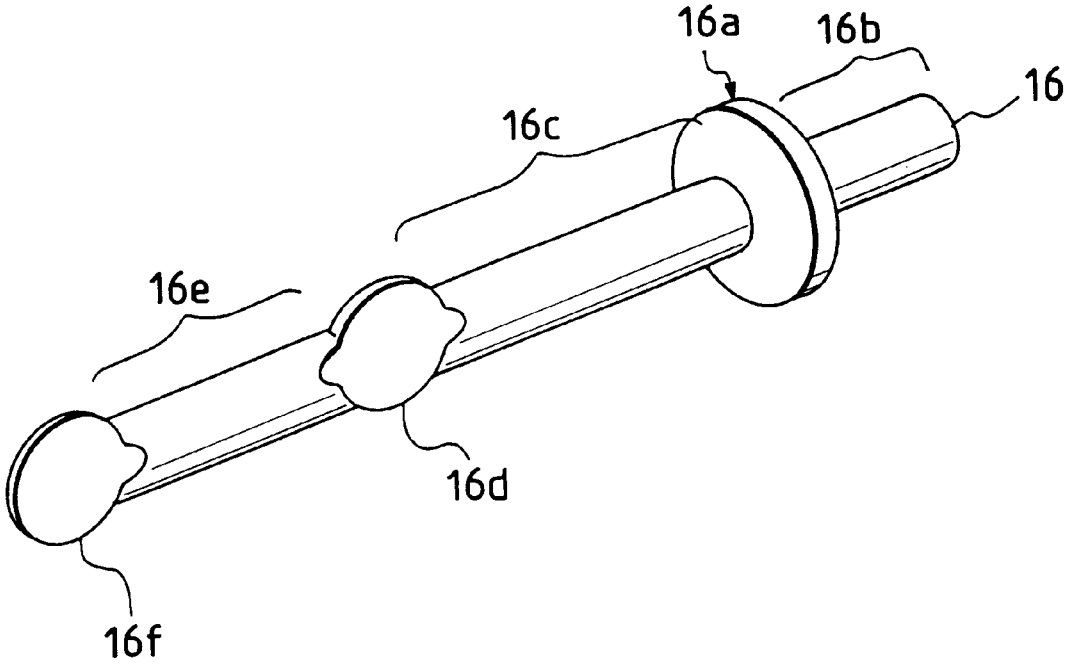
FIG. 24 is a perspective view of a terminal in a deflection yoke according to a fifth embodiment of this invention.

As shown in FIG. 24, the terminal 16 has a stick-like shape formed with an annular flange 16*a*. The terminal 16 has a base portion 16*b* extending from the flange 16*a* in the rightward direction as viewed in FIG. 24. The base portion 16*b* is fitted into the related aperture 7*d* in the base board 7 (see FIG. 5). The base portion 16*b* has a circular cross-section. The terminal 16 has a cylindrical portion 16*c* extending from the flange 16*a* in the leftward direction as viewed in FIG. 24. The cylindrical portion 16*c* has a circular cross-section. The terminal 16 has a flat portion 16*d* extending from the left-hand end of the cylindrical portion 16*c* in the leftward direction as viewed in FIG. 24. The flat portion 16*d* has a flat rectangular cross-section with four corners. The terminal 16 has a cylindrical portion 16*e* extending from the left-hand end of the flat portion 16*d* in the leftward direction as viewed in FIG. 24. The cylindrical portion 16*e* has a circular cross-section. The terminal 16 has a flat portion 16*f* extending from the left-hand end of the cylindrical portion 16*e* in the leftward direction as viewed in FIG. 24. The flat portion 16*f* has a flat rectangular cross-section. The flat portion 16*f* forms a tip of the terminal 16.

Sixth Embodiment

A sixth embodiment of this invention is similar to the first embodiment thereof except for the following design change. The sixth embodiment of this invention includes terminals 313 instead of the terminals 13. The terminals 313 are similar to each other. Only one of the terminals 313 will be explained in detail hereinafter.

Figure 25:
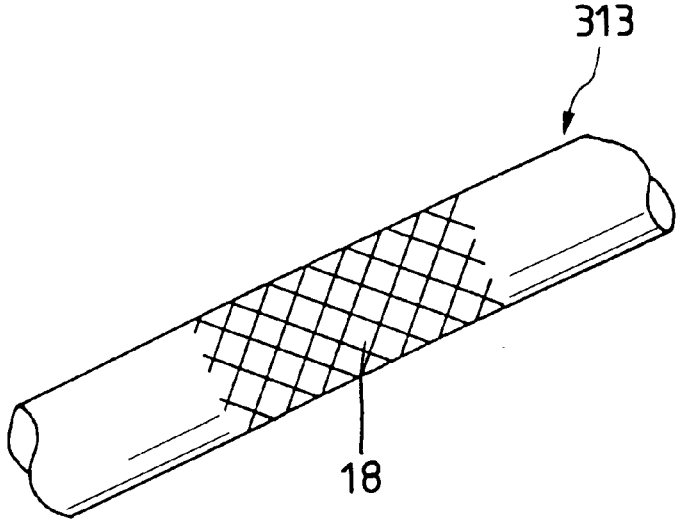
FIG. 25 is a perspective view of a portion of a terminal in a deflection yoke according to a sixth embodiment of this invention.

As shown in FIG. 25, the terminal 313 has a knurled portion 18 instead of a flat strip portion. The knurled portion 18 makes it easy to solder a lead to the terminal 313.

Other Embodiments

Figure 26:
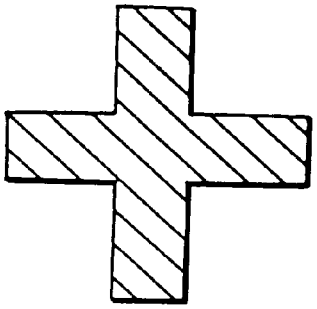
FIG. 26 is a sectional view of a terminal in a deflection yoke according to a first modified embodiment of this invention.

The flat strip portions 13*d* of the terminals 13 in the first embodiment, the flat strip portions 213*d* of the terminals 213 in the second embodiment, the flat portion s 14*d* and 14*f* of the terminals 14 in the third embodiment, or the flat portions 16*d* and 16*e* of the terminals 16 in the fifth embodiment may be modified into portions having a cross section with a cross shape such as shown in FIG. 26. The shape of the cross section in FIG. 26 has eight effective corners.

Figure 27:
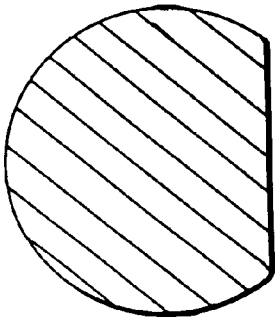
FIG. 27 is a sectional view of a terminal in a deflection yoke according to a second modified embodiment of this invention.

The flat strip portions 13*d* of the terminals 13 in the first embodiment, the flat strip portions 213*d* of the terminals 213 in the second embodiment, the flat portions 14*d* and 14*f* of the terminals 14 in the third embodiment, or the flat portions 16*d* and 16*e* of the terminals 16 in the fifth embodiment may be modified into portions having a circular cross-section which lacks an arcuate segment as shown in FIG. 27. The shape of the cross section in FIG. 27 has two effective corners.

Figure 28:
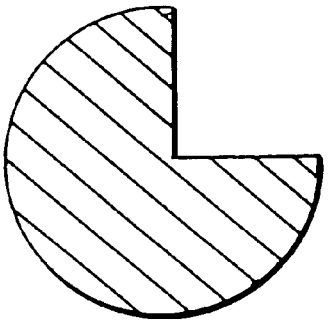
FIG. 28 is a sectional view of a terminal in a deflection yoke according to a third modified embodiment of this invention.

The flat strip portions 13*d* of the terminals 13 in the first embodiment, the flat strip portions 213*d* of the terminals 213 in the second embodiment, the flat portions 14*d* and 14*f* of the terminals 14 in the third embodiment, or the flat portions 16*d* and 16*e* of the terminals 16 in the fifth embodiment may be modified into portions having a circular cross-section which lacks a quarter circular segment as shown in FIG. 28. The shape of the cross section in FIG. 28 has two effective corners.

Figure 29:
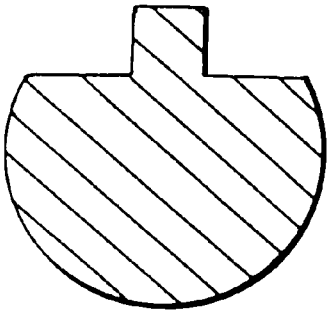
FIG. 29 is a sectional view of a terminal in a deflection yoke according to a fourth modified embodiment of this invention.

The flat strip portions 13*d* of the terminals 13 in the first embodiment, the flat strip portions 213*d* of the terminals 213 in the second embodiment, the flat portions 14*d* and 14*f* of the terminals 14 in the third embodiment, or the flat portions 16*d* and 16*e* of the terminals 16 in the fifth embodiment may be modified into portions having a circular cross-section which lacks an arcuate segment but which has a rectangular projection as shown in FIG. 29. The shape of the cross section in FIG. 29 has four effective corners.

Figure 30:
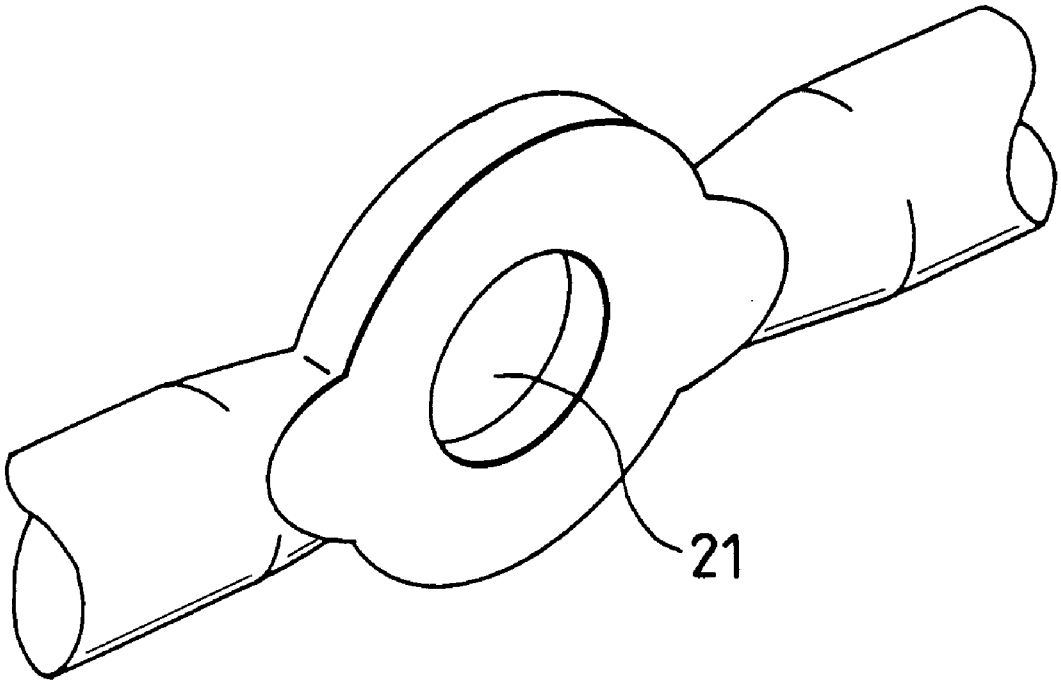
FIG. 30 is a perspective view of a portion of a terminal in a deflection yoke according to a fifth modified embodiment of this invention.

The flat strip portions 13*d* of the terminals 13 in the first embodiment, the flat strip portions 213*d* of the terminals 213 in the second embodiment, the flat portions 14*d* and 14*f* of the terminals 14 in the third embodiment, or the flat portions 16*d* and 16*e* of the terminals 16 in the fifth embodiment may be modified into portions having a circular hole 21 as shown in FIG. 30. The circular hole 21 tends to be filled with solder. Accordingly, the circular hole 21 makes it easy to solder a lead to the related terminal.

What is claimed is:

1. A deflection yoke comprising:

a horizontal deflection coil;

a vertical deflection coil;

a separator having a neck side and a face side, the separator supporting the horizontal deflection coil and the vertical deflection coil, the separator having an axis extending between the neck side and the face side;

at least one claw being integral with the separator and projecting in a direction perpendicular to the axis of the separator;

a third coil being different from the horizontal deflection coil and the vertical deflection coil, and being supported on the separator;

a base board being supported by the claw, and extending in parallel with the axis of the separator, the base board being apart from the horizontal deflection coil, the vertical deflection coil, and the third coil;

a terminal mounted on the base board and extending from the base board; and a lead extending from one of the horizontal deflection coil, the vertical deflection coil, and the third coil through a side of the base board opposite to the terminal and including a non-wound portion and plural turns constituting a wound portion on the terminal, the wound portion having a first portion extending around a distal portion of the terminal, the wound portion having a second portion extending around a base portion of the terminal, the first portion being soldered to the terminal, the second portion being non-soldered to the terminal, the second portion including plural turns forming a contractible and expandable helical spring which absorbs an externally applied force substantially in a longitudinal direction of the terminal effectively preventing breakage of said lead near said first soldered portion.

2. A deflection yoke as recited in claim 1, wherein the terminal has a first portion whose cross-sectional shape has a corner, and a second portion which is substantially circular in cross section, and wherein the first portion of the wound portion of the lead extends around the first portion of the terminal, and the second portion of the wound portion of the lead extends around the second portion of the terminal.

3. A deflection yoke as recited in claim 1, wherein the terminal has a first portion which is substantially rectangular in cross section, and a second portion which is substantially circular in cross section, and wherein the first portion of the wound portion of the lead extends around the first portion of the terminal, and the second portion of the wound portion of the lead extends around the second portion of the terminal.

* * * * *